United States Patent [19]

Lesley

[11] 4,202,185

[45] May 13, 1980

[54] WARP KNITTING MACHINE

[75] Inventor: Bascum G. Lesley, Pickens, S.C.

[73] Assignee: Milliken Research Corporation, Spartanburg, S.C.

[21] Appl. No.: 948,787

[22] Filed: Oct. 5, 1978

[51] Int. Cl.[2] ..... D04B 23/00

[52] U.S. Cl. ..... 66/203; 66/104; 66/109

[58] Field of Search ..... 66/203, 204, 104, 109

[56] References Cited

U.S. PATENT DOCUMENTS 2,090,970 8/1937 Wirth ..... 66/204

FOREIGN PATENT DOCUMENTS 279552 10/1914 Fed. Rep. of Germany ..... 66/203

750891 6/1956 United Kingdom ..... 66/204

*Primary Examiner*—Ronald Feldbaum

*Attorney, Agent, or Firm*—Earle R. Marden; H. William Petry

[57] ABSTRACT

An improved warp knitting machine employing compound needles and an interconnected trick-sinker mechanism which maintains a fixed relationship with the knitting needles and tends to hold the knitted fabric in line with the back guide bar to lessen the stress on the knitting needles.

5 Claims, 7 Drawing Figures

WARP KNITTING MACHINE

The knitting speed of a knitting machine and the tendency to require considerable repair thereto is partially dependent on the number of moving parts as well as the tension of the yarn on the knitting needles as the fabric is being produced.

Therefore, it is an object of the invention to provide an improved knitting machine with less moving parts which results in higher operating speeds and require less maintenance.

Other objects and advantages of the invention will become readily apparent as the specification proceeds to describe the invention with reference to the accompanying drawings, in which.

Figure 1:
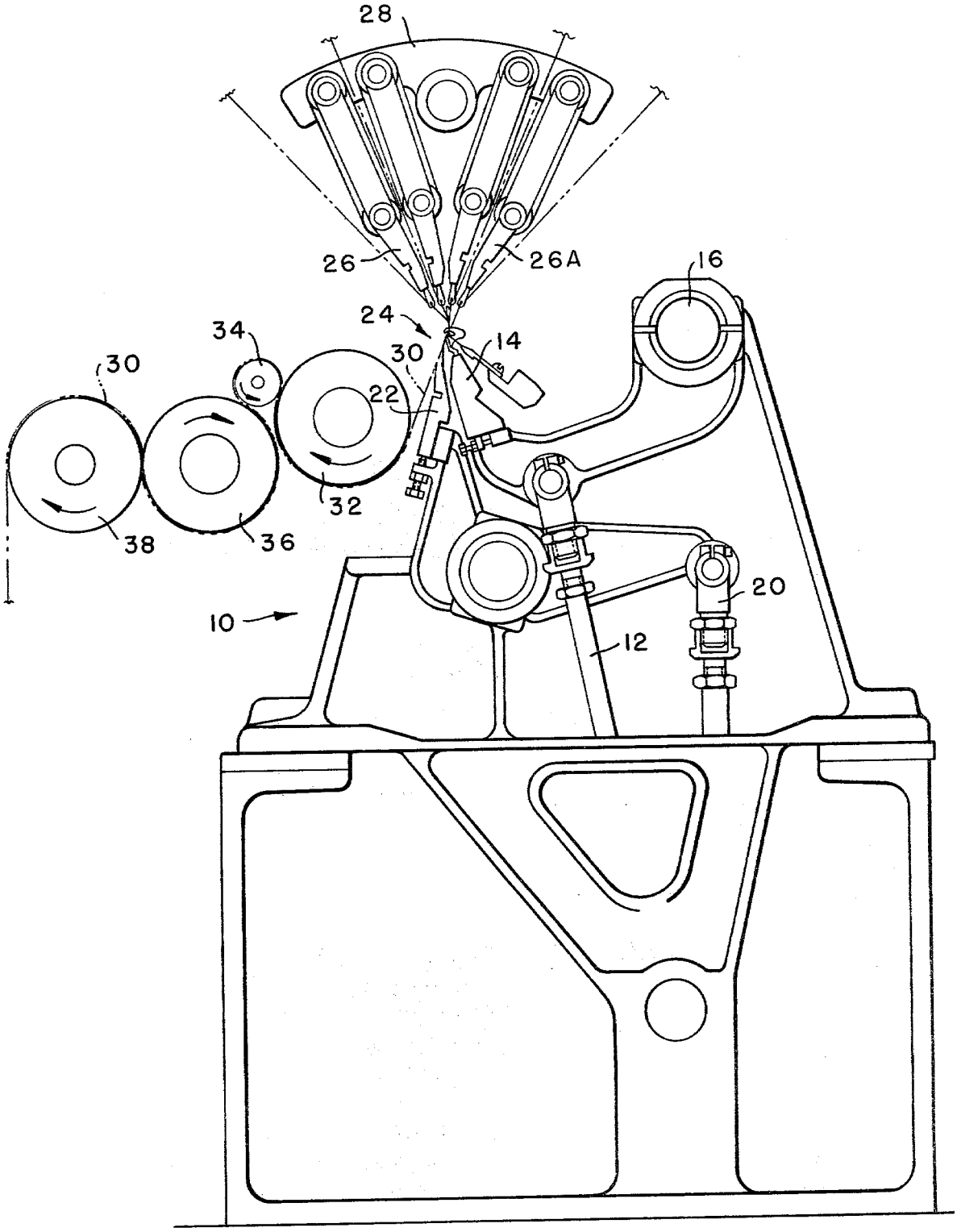
FIG. 1 represents a partially schematic side elevation view of the new, improved warp knitting machine.
Figure 2:
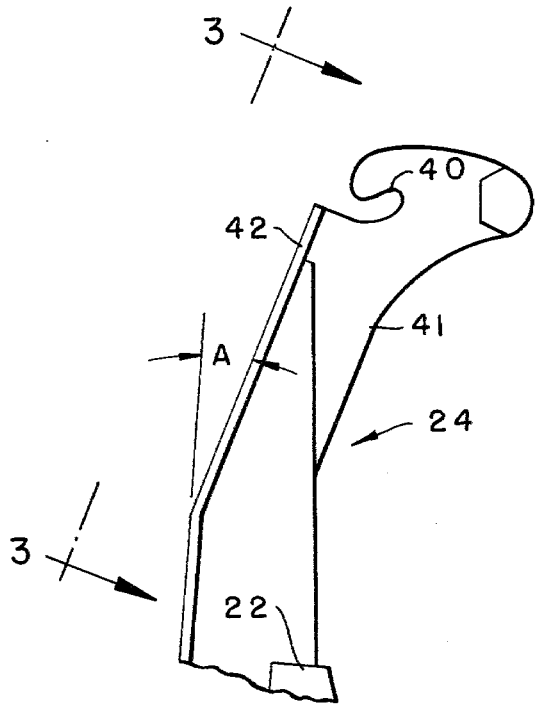
FIG. 2 is a side elevation view of the novel combination trick-sinker mechanism.
Figure 3:
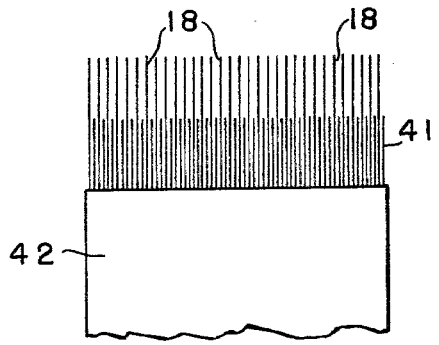
FIG. 3 is a view taken on line 3—3 of FIG. 2.

Looking now to FIG. 1, the reference numeral 10 represents the new and improved warp knitting machine which is conventionally driven by a machine crankshaft (not shown). The crankshaft coordinates and drives the push rods 12 to pivot the needle base 14 around the shaft 16 to reciprocate the compound needles 18. The push rods 20 pivot the sinker bar 22 to impart slight rotational movement of the trick-sinker 24 to coordinate its movement with the needles 18 and the guide bars 26, the movement of which is controlled by the guide bar rocker arm 28. In conventional manner, the guide bar rocker arm is driven by a suitable connection to the knitting machine crank shaft. The warp fabric 30 knit at the needles 18 is delivered to the take-up roll (not shown) by suitable rolls 32, 34, 36 and 38.

The combination trick-sinker 24 allows the knitting machine 10 to knit any fabric that can be knit on a tricot or raschel warp knitting machine but has eliminated the necessity for certain moving parts on such machine resulting in increased knitting machine speed up to at least 1500 courses/minutes. For example, the sinker and the latch wires of the raschel machine has been eliminated while the presser bar of the tricot machine has been eliminated. The trick-sinker 24 moves with the guide bars 26 and maintains a pre-determined relationship with the needles 18 and the sinker throat 40 of the thin plate members 41 to hold the knitted fabric 30 on the trick band 42 to allow the needles 18 to cast off the previously knit course but prevent the fabric 30 from moving with the needles 18 as they are retracted. Further, the trick band 42 of the trick-sinker 24 is so positioned to maintain an acute angle "A" of approximately 27 degrees with the vertical axis of the needles in order to align the knitted fabric 30 with the yarn from the back guide bar in order to maintain minimum stress and tension on the needles 18 to minimize breakage of needles and yarns.

OPERATION

Figure 4:
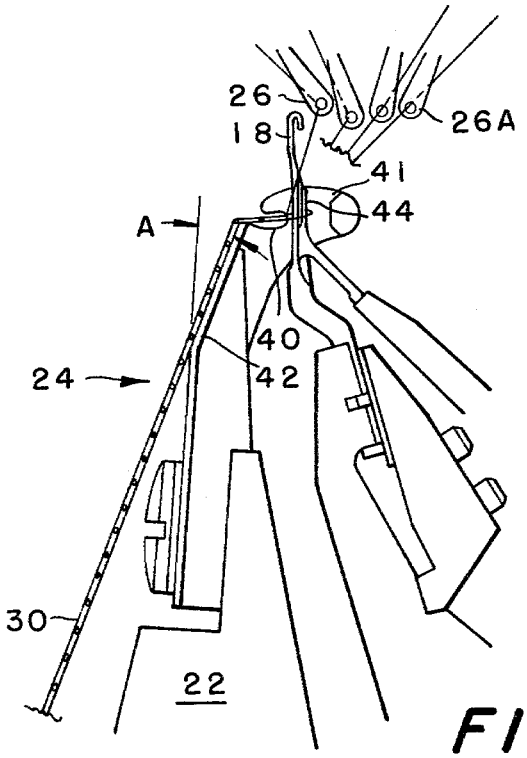
FIGS. 4–7 represent schematically the operation of the new improved knitting machine.
Figure 5:
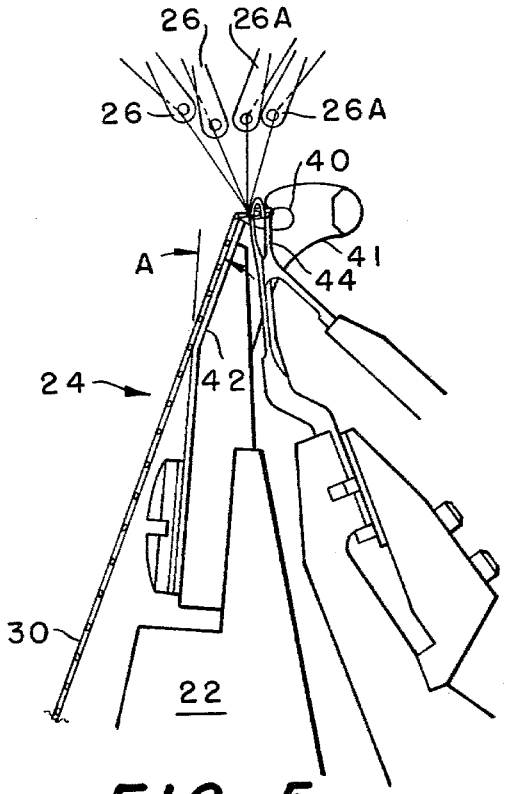
Figure 6:
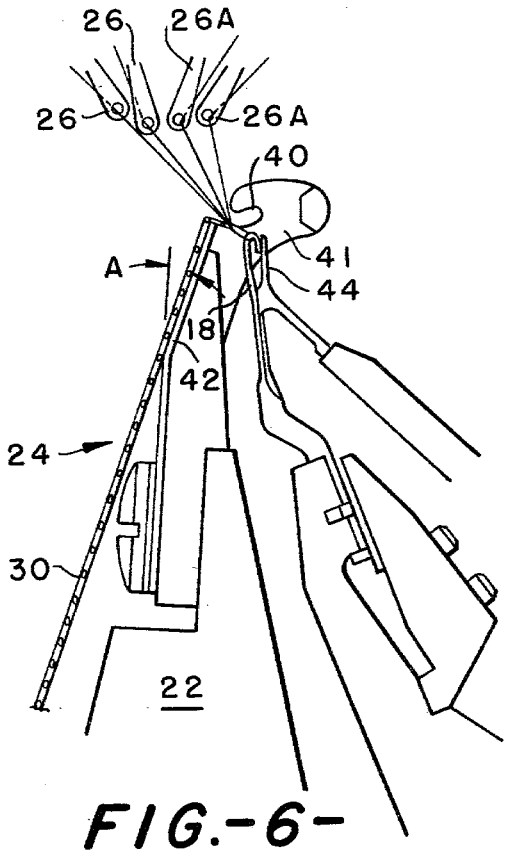
Figure 7:
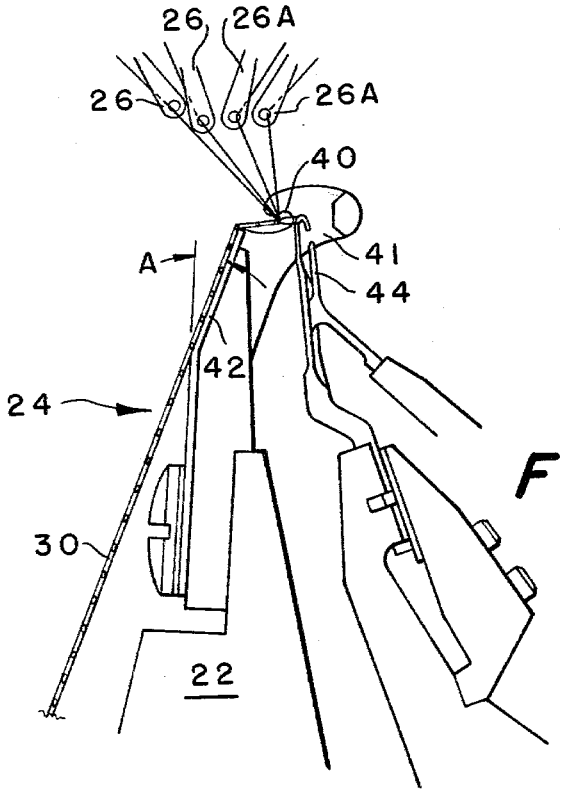

Looking now to FIGS. 4–7, the basic knitting steps are shown. In FIG. 4, the guide bars 26 are behind the needles 18 ready for lateral movement, the needles 18 are in the up position and the trick-sinker 24 has been pivoted by the push rods 20 to its extreme counter-clockwise position. Then, as shown in FIG. 5, the guide bars 26 have been moved laterally and to the most forward position while the needles 18 have been lowered to cooperate with the closing wire 44 to pull the newly formed loop through the previously formed loop and allow the previously formed loop to cast off. At the same time, the trick-sinker is being pivoted, counter-clockwise to allow the fabric 30 entrance into the throat 40. Then, as shown in FIG. 6, the needles 18 continue to move downward to pull the loop to its maximum length while the pivotal movement of the trick-sinker 24 is reversed to hold the fabric 30 onto the trick band 42 to prevent the fabric 30 from being pulled down with the needles 18. When the trick member has moved to its extreme counter-clockwise position as shown in FIGS. 4 and 7, the needles 18 are moved upwardly through the formed loop (FIG. 7) away from the closing wire 44 towards the needle position shown in FIG. 4 for the next loop forming operation. At the same time, the guide bars 26 are moved from the position in front of needles as shown in FIG. 7 to the extreme rearward position of FIG. 4 ready to knit the next course of fabric.

It can be seen that the acute angle "A" has been maintained substantially constant while the knit fabric 30 has been held in the trick band while the needles 18 are being retracted. Furthermore, it is obvious from the construction of the trick-sinker mechanism that the needles 18 can be replaced without excessive removal of machine parts thereby resulting in much less down time for replacement of broken needles.

Although I have described the preferred embodiment of my invention, I contemplate that changes may be made without departing from the scope or spirit of the invention and I desire to be limited only by the scope of the claims.

I claim:

1. A trick-sinker for a warp knitting machine comprising: a trick-sinker support member, a trick sinker band mounted on one side of said trick-sinker support and a plurality of thin plate members spaced from another to accommodate a knitting needle between adjacent plate members and connected to said trick-sinker support member on the side thereof away from said trick sinker band, each of said thin plate members having a sinker throat closely adjacent the top of said trick sinker band and opening towards said trick sinker band.

2. A warp knitting machine comprising: a frame, yarn guide bars operably associated with said frame, means supplying warp yarn to each of said guide bars, a plurality of knitting needles operably associated with said guide bars and receiving yarn therefrom and trick-sinker means mounted on said frame adjacent said knitting needles to allow knit fabric to be cast off said needles without the fabric being pulled back by said needles and to guide the knit fabric away from said needles in substantial alignment with the warp yarn being supplied to one of said guide bars, said trick-sinker means having a trick-sinker band on one side thereof to provide a planar guiding surface for the knit fabric, said trick-sinker means having a plurality of thin plate members connected thereto on the side thereof away from said trick-sinker band with one of said needles being located between two adjacent thin plate members, each of said thin plate members having a throat portion closely adjacent the top of said trick-sinker band cooperating with said knitting needles, said throat portion opening in a direction towards said trick-sinker band.

3. The machine of claim 2 wherein said knitting needles are compound needles and a closing wire is mounted on said machine adjacent each of said needles to close said needles when said needles are being moved towards the downward position.

4. The machine of claim 2 wherein the knitting machine employs at least four guide bars.

5. The machine of claim 4 wherein the knitted fabric is held in substantial alignment with the back guide bar of said plurality of guide bars.

* * * * *